United States Patent [19]

Gyori

[11] Patent Number: 4,706,736

[45] Date of Patent: Nov. 17, 1987

[54] MULTI-ZONE HEATER ARRANGEMENT FOR CONTROLLING THE TEMPERATURE OF A FLOWING MEDIUM

[75] Inventor: Steven A. Gyori, Pomona, N.Y.

[73] Assignee: Technicon Instruments Corporation, Tarrytown, N.Y.

[21] Appl. No.: 865,365

[22] Filed: May 20, 1986

[51] Int. Cl.[4] ..... F25B 29/00

[52] U.S. Cl. ..... 165/30; 219/367; 219/370; 219/400; 219/364; 165/64

[58] Field of Search ..... 219/367, 369, 370, 400, 219/364; 236/78 B; 165/30, 64

[56] References Cited

U.S. PATENT DOCUMENTS

| | | | |
|---|---|---|---|
| 2,609,183 | 9/1952 | Fitzgerald | 236/37 |
| 3,594,546 | 7/1971 | Smilie | 236/37 |
| 3,609,183 | 9/1952 | Fitzgerald | 236/37 |
| 3,669,349 | 6/1972 | Hall Jr. | 236/49 |
| 3,734,402 | 5/1973 | Morgan | 236/99 |
| 4,017,028 | 4/1977 | Manor | 236/91 F |
| 4,189,093 | 2/1980 | Schanibel et al. | 236/37 |
| 4,320,870 | 3/1982 | Manor | 236/37 |
| 4,393,662 | 7/1983 | Dirth | 236/46 F |
| 4,491,270 | 1/1985 | Brand | 236/49 |

*Primary Examiner*—Patrick R. Salce
*Assistant Examiner*—Jeffrey Sterrett
*Attorney, Agent, or Firm*—Scully, Scott, Murphy & Presser

[57] ABSTRACT

A multi-zone heater arrangement for controlling the temperature of a gaseous medium, such as air, being conveyed through the heater which is located within a flow duct for the medium, and more particularly, an arrangement for compensating temperature deviations in the gaseous medium conveyed through the respective zones of the heater. Moreover, also disclosed is a method for controlling the temperature of the gaseous medium as it is conveyed through the multi-zone heater to compensate for temperature differentials in the gaseous medium.

17 Claims, 2 Drawing Figures

MULTI-ZONE HEATER ARRANGEMENT FOR CONTROLLING THE TEMPERATURE OF A FLOWING MEDIUM

BACKGROUND OF THE INVENTION

1. Field of the Invention

The present invention relates to a multi-zone heater arrangement for controlling the temperature of a gaseous medium, such as air, being conveyed through the heater which is located within a flow duct for the medium, and more particularly, relates to an arrangement for compensating temperature deviations in the gaseous medium conveyed through the respective zones of the heater. Moreover, the invention also relates to a method for controlling the temperature of the gaseous medium as it is conveyed through the multi-zone heater to compensate for temperature differentials in the gaseous medium.

In many industrial, experimental and laboratory applications it is frequently necessary to maintain an accurate control over liquids which are employed in chemical reactions; for example, through an air bath surrounding the liquids, in order to avoid adversely influencing the optical quality of the liquids, by precisely regulating the temperature of a gaseous medium forming the air bath, such as air. To be able to accomplish the foregoing, it may be required to maintain the temperature of the liquid employed in the chemical reaction within an extremely narrow range; for instance, within ±0.2° C. inasmuch as any more extensive fluctuations in the temperature of the liquids, such as a 1° C. change in temperature, may conceivably produce a 10% deviation in the chemical reaction of the liquid and adversely affect the optical properties thereof. Consequently, it is important to provide an air bath, in which a flow of a gaseous medium, such as air surrounding the liquid employed in the chemical reaction, is maintained within an accurate temperature ranges at all locations across the path of flow of the medium.

2. Discussion of the Prior Art

The necessary level of precision or of accuracy in controlling or maintaining constant the temperature of the liquid of the reaction cannot be attained through the intermediary of presently known devices which are employed for regulating the temperatures of the medium in air heaters. Thus, in order to provide a method for more precisely controlling and/or compensating for deviations in the temperature of a flow of gaseous medium or air conveyed through a heater which is employed in producing an air bath for regulating and/or maintaining constant the temperature of the liquid of the chemical reaction.

Although numerous systems, devices and methods are currently utilized in various technologies for controlling and/or regulating the temperature of an airflow which is conveyed through discrete or multiple zones, none of these are adapted to facilitate the obtention of an accurate and uniform temperature control over the flow of a gaseous medium for an air bath, such as air, measured at all locations over the cross-sectional area of a flow chamber or ducting in a heater.

Fitzgerald U.S. Pat. No. 2,609,183 discloses a control apparatus for regulating the temperature in a plurality of the airflow ducts of an air conditioning system, in which a plurality of zones may have air supplied thereto at predetermined temperature levels. Suitable sensors and temperature regulators are arranged in each of the multiple zones so as to enable the temperature levels therein to be regulated relative to each other. However, although the system disclosed in this publication provides for controlling the temperature of air in a plurality or multiple of zones, it is not adapted to facilitate the obtaining of highly precise regulation and compensations in the temperature of the airflow such that air discharged therefrom will be regulated to a degree which is necessary for thermally-controlled air baths employed for the chemical reactions of liquids.

Hall, Jr. U.S. Pat. No. 3,669,349 discloses an airflow control system in which temperatures are controlled in a multiplicity of zones in flow ducts through regulating the size of flow apertures in the separate airflow ducts, so as to enable control over the temperature in each of the flow ducts by varying the flow conditions of the air. This disclosure does not provide for controlling the temperature of an airflow which conducted through a plurality of separate zones of a heater so as to allow for a precise control over the temperature at the discharge end of the heater with a sufficient degree of accuracy to enable precise regulation and uniformity of the air temperature of an air bath formed by the airflow which is employed in the chemical reactions of liquids and the like.

Brand U.S. Pat. No. 4,491,270 discloses a temperature controlled system for regulating the temperature of a plurality of zones in a thermally-actuated diffuser through the use of different sensors located at various locations therein, and in which temperature differentials ascertained by the sensors will allow for the varying of a volumetric flow of air to provide for changes in temperature. This system, in utilizing the thermally-actuated diffuser, is incapable of affording the accurate heating of an airflow through multi-zone heater which would permit the discharge of airflow under precisely controlled temperature conditions for an air bath employed for chemical reactions of a liquid.

Dirth U.S. Pat. No. 4,393,662 discloses an air conditioning or refrigeration system in which coolant flow through multiple zones are controlled in response to sensed temperature conditions. There is no disclosure of an airflow being conducted through a single flow duct which has a multi-zone heater interposed therein to allow for controlling the temperature of the airflow through each of the zones in order to compensate for temperature differentials in the airflow in each zone.

Manor U.S. Pat. No. 4,017,028 discloses a differential temperature sensing and control device wherein an airflow through multiple conductors is regulated by sensing the temperature differential present between the ducts through the actuation of a diaphragm valve and switch. Again, there is no disclosure of a multi-zone heater being interposed in a flow duct for an airflow employed as an air bath for chemical reactions which will enable the temperature of the airflow to be regulated and temperature differentials compensated for eliminating thermal deviations across the flow cross-section of the air duct.

SUMMARY OF THE INVENTION

Accordingly, it is an object of the present invention to provide a multi-zone heater arrangement in which the flow of a gaseous medium has the temperature thereof regulated in each heater zone, such that upon recombination of the flow of the medium from each of the zones of the heater, there is obtained an accurately-regulated and uniform temperature across the flow at the discharge of the heater arrangement.

Another and more specific object of the present invention resides in the provision of a multi-zone heater arrangement of the type described, which is interposed in and extends across a flow duct for a gaseous medium, such as air, in which temperature differentials in each of the zones are individually sensed through suitable temperature sensors, and the flow of air through each of the zones may be individually heated in response to sensed temperature deviations in order to impart temperature to the airflow exiting from each heater zone which is accurately regulated to provide a uniform temperature over the cross-section of the airflow discharged from the arrangement.

Still another object of the present invention is to provide a multi-zone heater arrangement of the type described, in which the regulated and uniformly heated flow of air is employed as an air bath for the chemical reaction of a liquid.

A further object of the present invention contemplates the provision of a method for accurately controlling the uniformity in the temperature of an air bath employed in a chemical reaction for a liquid, through the utilization of the inventive multi-zone heater arrangement.

The foregoing objects are inventively attained through the utilization of the multi-zone heater which is interposed in and extends across a cylindrical flow duct for a gaseous medium, such as air which is employed as an air bath for a chemical reaction of a liquid, and in which the flow of air is divided into a plurality of streams each conducted through respectively a zone of the multi-zone heater, wherein there is sensed the temperature of the air exiting from each zone of the heater, and any temperature deviations of each airflow exiting from each zone are compensated for by individually heating each heater zone to a predetermined extent so as to impart a uniform temperature to the recombining airflow over the cross-section thereof as the flow emanates from the arrangement. For this purpose, each of the zones of the multi-zone heater has suitable heating elements extending thereacross, the temperature of which may be controlled in response to the sensed airflow temperatures downstream of the multi-zone heater, to enable individual temperature compensations to be imparted to the flow of air at each of the zones and to produce an airflow possessing a substantially uniform temperature over its entire flow cross-section.

BRIEF DESCRIPTION OF THE DRAWINGS

Reference may now be had to the following detailed description of a preferred embodiment of the multi-zone heater pursuant to the invention, taken in conjunction with the accompanying drawings; in which.

DETAILED DESCRIPTION

Figure 2:
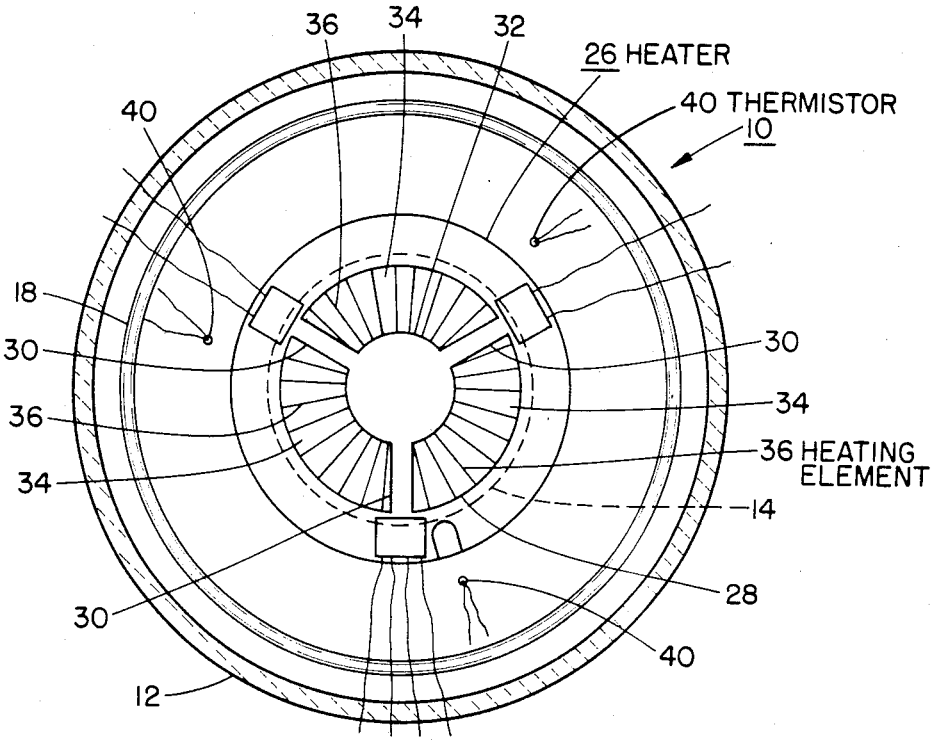
FIG. 2 is a sectional view of the arrangement taken along line 2—2 in FIG. 1.
Figure 1:
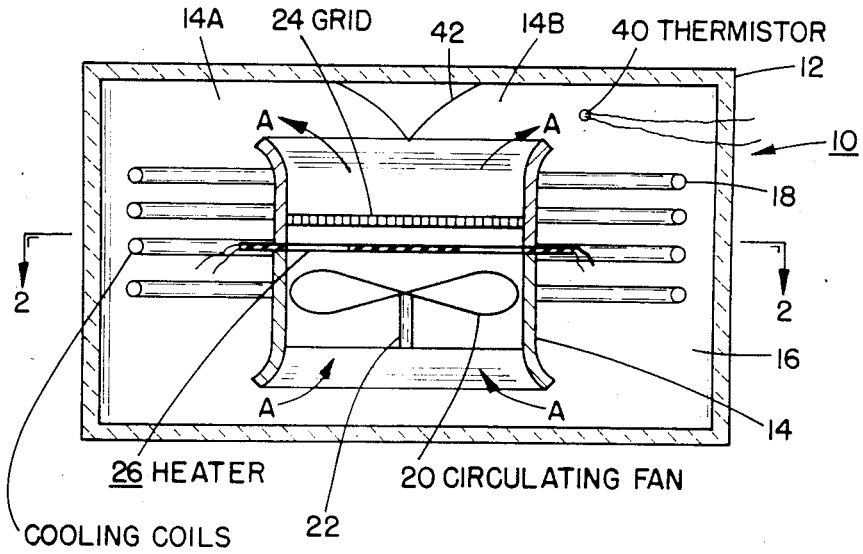
FIG. 1 illustrates, generally schematically, a transverse longitudinally sectional view through an arrangement for controlling the temperature of a gaseous medium and incorporating a multi-zone heater pursuant to the invention.

Referring now in detail to the drawings, the arrangement 10 for controlling the temperature and/or compensating for deviations in the temperature of a gaseous medium, such as air includes a sealed chamber 12 essentially constituted of a cylindrical insulated wall structure, having a cylindrical duct 14 with a central flow passageway therein, through which a stream of a gaseous medium such as air is conducted along a flow path as shown by arrows A. The surrounding space 16 between the cylindrical duct 14 and the insulated outer casing 12 is provided for the necessary air circulation and is adapted to have various electronic components arranged therein, and if desired, may additionally contain a plurality of cooling coils 18 for circulating of a cooling medium, for a purpose as described hereinbelow. In order to assist in the drawing of the gaseous medium through the duct 14, a circulating fan 20 is located therein, which is rotated by means of a suitable drive unit or motor (not shown) connected to the end of the fan shaft member 22.

A grid-like disc 24 extends across the flow passageway of duct 14, and which comprises suitable guide vanes or flow straighteners to direct the flow of air into the annular duct area defined by reference numerals 14A and 14B towards and into the upper end of the space 16 in a uniformly distributed manner along the path of flow identified by upper arrows A for recirculation towards the lower or inlet end of flow duct 14.

In order to cause the flow of the gaseous medium or air to be uniformly heated over its entire cross-section as it passes through the cylindrical flow duct 14, interposed in the duct 14 between between the circulating fan 20 and the flow straightener 24, and extending transversely across the flow passageway for the gaseous medium defined by the duct 14, is the inventive multi-zone heater 26.

The multi-zone heater 26 basically includes a ring-shaped flat disc 28 of a thermally and electrically insulative material such as rubber, or neoprene and the like whose inner diameter corresponds to the inner wall diameter of the duct 14 and is suitably fastened thereto. A plurality of radially inwardly extending and circumferentially spaced webs or spokes 30 which are of the same material as the ring-shaped disc 28, and may be integrally formed therewith, and centrally joining or integrally formed with a disc-shaped member 32. As a consequence, a plurality of separate or discrete, substantially wedge-shaped flow passageways 34 are formed between each of the spokes 30 the ring-shaped disc 28 and member 32 for the gaseous medium, so as to divide the flow thereof into separate streams within the duct 14.

The multi-zone heater 26 possesses a plurality of heating elements 36, preferably constituted of metal wires having exposed or bare portions extending radially and over the wedge-shaped passageways 34, wherein the wires may be nichrome wires or the like, and the radially inner and outer ends of which are embedded in, respectively, the elements 32 and 28. The heating elements 36 for each passageway 34 are connected in such a manner to a supply of electrical current (not shown) as to enable the elements 36 for each passageway 24 to be heated separately to different temperatures.

Towards the discharge end of the flow passageway defined by the duct 14 downstream of the flow straightener 24 and the multi-zone heater 26, the duct 14 divides into the annular sections 14A, 14B for conveying the flow of the gaseous medium into the annular space 16 for the intended use thereof; for example, as an air bath for the chemical reactions of liquids. Positioned in circumferential spacings in the duct sections 14A, 14B are thermistors 40, each of which is in operative communication and association with a respective zone 34 of the multi-zone heater 26, and which accurately senses the temperature of the gaseous medium emanating from that particular heater zone.

Each thermistor 40, which may be a suitable temperature probe as is well known in the technology, is connected to a suitable controller (not shown), to which there are also connected the heating elements 36 of each zone 34, so as to be adapted to practically instantaneously sense any temperature differentials between the airflows exiting from each of the respective heater zones 34, and responsive thereto, cause the controller to selectively impart appropriate electrical current to the heating wires of one or more of the heater zones 34, thereby adjusting the temperature radiated by the heating elements 36. As a result, the gaseous medium flow through that particular heater zone will be heated differently relative to the flow of the medium passing through another heater zone or zones 34, and consequently compensating for any temperature deviations between the flows conducted through the individual heater zones 34. Consequently, in view of the foregoing operation, the thermistors 40 will ensure that the temperatures of the gaseous medium or airflow exiting from each of the heater zones 34 will, at all times, be uniform across the discharge from the duct 14 into the annular duct flow sections 14A, 14B.

The inventive arrangement and method provides for a uniformity of temperature of each gaseous medium or airflow portion exiting from each of the zones 34 of the heater to be maintained within a range of ±0.1° C., which normally cannot be achieved through the use of presently known air mixing and heater devices. Consequently, the optical quality of any liquids which are being chemically processed, which would be adversely effected by any excess changes or deviations in temperature of the air bath provided by the airflow; for instance, in which every 1° change in air temperature may cause a possible 10% deviation in a chemical reaction, is maintained at an optimum level.

By means of the present invention, it is possible to provide for temperature increases of up to 250° F. while maintaining the desired degree of uniformity in the temperature of the gaseous medium flowing through each zone 34 of the multi-zone heater 26. To this effect, in order to be able to increase the thermal range of operation of the entire arrangement 10, a suitable cooling medium, such as a refrigerant or coolant; in effect, freon, may be circulated through the cooling coils 18 positioned in the space 16 surrounding the flow passageway or duct 14.

Although the invention has been disclosed with a multi-zone heater 26 possessing three flow zones 34, it is readily apparent that the heater may have only two zones, or four zones and greater, dependent upon need and physical applications thereof.

From the foregoing, it clearly appears that the invention is extremely advantageous for employment in the temperature control of liquids being subjected to a chemical reaction, in that the liquid is maintained under extremely accurately-controlled thermal environment operating conditions.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. An arrangement for controlling the temperature of a gaseous medium being circulated through a sealed flow chamber; duct means in said flow chamber forming a passageway for said gaseous medium; a multi-zone heater being interposed in said passageway for separating the flow of said gaseous medium into a plurality of separate flows each passing through respectively one zone of said heater; thermal sensing means in said passageway downstream of said heater for sensing the temperature of each of said separate flows of said gaseous medium exiting from each zone of said heater; and means for individually regulating the temperature in each said flow zone for selectively heating the flow of the gaseous medium passing through said zone to compensate for sensed temperature differentials in the gaseous medium flowing through said zones and to impart a uniform temperature over the cross-section of the flow of the gaseous medium circulating through said arrangement.

2. An arrangement as claimed in claim 1, wherein said multi-zone heater is centrally supported within said duct means so as to extend transversely across the path of flow of said gaseous medium through said duct means, said duct means being a cylindrical duct, said multi-zone heater including partitioning means extending across said cylindrical duct to form a plurality of separate flow zones for said gaseous medium passing through said heater; at least one said temperature sensing means being associated with respectively each one of said flow zones of said heater for measuring the temperature of the gaseous medium exiting from said zone.

3. An arrangement as claimed in claim 2, wherein said temperature regulating means comprise a plurality of temperature-controllable heating elements extending across each of said heater zones transverse to the direction of flow of said gaseous medium through said zones.

4. An arrangement as claimed in claim 3, wherein said partitioning means comprises a ring-shaped, electrically and heat-insulated member supported along the inner cylindrical wall of said duct means, said ring-shaped member having an inner diameter corresponding to the inner diameter of said cylindrical duct wall, said partitioning means being a plurality of circumferentially spaced spokes extending radially inwardly from said ring-shaped member and joined at their inner ends so as to form said heater zones therebetween.

5. An arrangement as claimed in claim 3, wherein said heating elements are each constituted of exposed heating wires extending across said heater zones, the opposite ends of said heating wires being embedded in respectively said ring-shaped member and in the central juncture of said spokes.

6. An arrangement as claimed in claim 5, wherein said heating elements are constituted of nichrome wires.

7. An arrangement as claimed in claim 2, comprising cooling coils being arranged in the space intermediate said chamber and said duct means.

8. An arrangement as claimed in claim 7, wherein said chamber is a heat-insulated sealed cylindrical chamber.

9. An arrangement as claimed in claim 2, comprising an air-circulating fan mounted in said duct means upstream of said multi-zone heater for uniformly distributing the flow of said gaseous medium to each of said heater zones.

10. An arrangement as claimed in claim 2, comprising flow straightener means positioned in said duct means downstream of said multi-zone heater to provide a uniformly distributed flow of temperature-regulated gaseous medium from said, heater zones.

11. An arrangement as claimed in claim 2, wherein said heating elements are connected to a source of electrical current for independently heating the elements of each zone of said multi-zone heater responsive to temperature conditions of said gaseous medium sensed by said thermal sensing means.

12. An arrangement as claimed in claim 1, wherein said thermal sensing means comprise thermistors.

13. An arrangement as claimed in claim 1, wherein said gaseous medium comprises air.

14. A method for controlling the temperature of a gaseous medium being circulated through a sealed flow chamber; comprising conveying said medium through duct means interposed in said flow chamber and forming a passageway for said gaseous medium; conducting said flow of medium through a multi-zone heater interposed in said passageway to separate the flow of said gaseous medium into a plurality of separate flows each passing through respectively one zone of said heater; sensing the temperature of each of said separate flows of said gaseous medium exiting from each zone of said heater; individually regulating the temperature in each said zone for selectively heating the flow of the gaseous medium passing through said passageway to compensate for sensed temperature differentials in the gaseous medium in said zones so as to impart a uniform temperature to the flow of the gaseous medium circulating through said flow chamber.

15. A method as claimed in claim 14, comprising positioning said multi-zone heater centrally within said duct means so as to extend transversely across the path of flow of said gaseous medium through said duct means and forming a plurality of separate flow zones for said gaseous medium through said heater; and individually regulating the temperature of each flow of medium from said heater responsive to measuring the temperature of the gaseous medium exiting from said zones.

16. A method as claimed in claim 14, wherein said gaseous medium comprises air.

17. A method as claimed in claim 14, comprising connecting said heater to a source of electrical current for independently heating each zone of said multi-zone heater responsive to the sensed temperature conditions of said gaseous medium downstream of said heater.

* * * * *